United States Patent [19]

Niemann

[11] 4,160,293

[45] Jul. 10, 1979

[54] DRAIN VALVE ASSEMBLY

[75] Inventor: James E. Niemann, Louisville, Ky.

[73] Assignee: American Standard Inc., New York, N.Y.

[21] Appl. No.: 898,005

[22] Filed: Apr. 20, 1978

Related U.S. Application Data

[63] Continuation of Ser. No. 766,167, Feb. 7, 1977, abandoned.

[51] Int. Cl.[2] ..... E03C 1/262

[52] U.S. Cl. ..... 4/291; 4/295

[58] Field of Search ..... 4/286, 287, 291, 292, 4/295, DIG. 14

[56] References Cited

U.S. PATENT DOCUMENTS 3,771,177 11/1973 Rogers et al. ..... 4/287

*Primary Examiner*—Charles E. Phillips

*Attorney, Agent, or Firm*—James J. Salerno, Jr.; Robert G. Crooks

[57] ABSTRACT

A drain valve assembly adapted for use with sinks, lavatories, and tubs is disclosed. The drain valve assembly comprises a valve body or drain sleeve which is mounted in the drain port or opening of the sink, lavatory, or tub and includes a valve seat formed around its open upper end and a stud axially mounted within the drain sleeve. A removably mounted stopper is positioned within the drain sleeve for axial reciprocation on the stud. The stopper is provided with gripping means which cooperate with stop means formed on the stud for holding the stopper either in a raised or open position or a lowered or closed position. A resilient seal means is mounted on the stopper for seating in fluid tight relation with the valve seat at the open outer end of the drain sleeve when the stopper is in the lowered or closed position.

5 Claims, 4 Drawing Figures

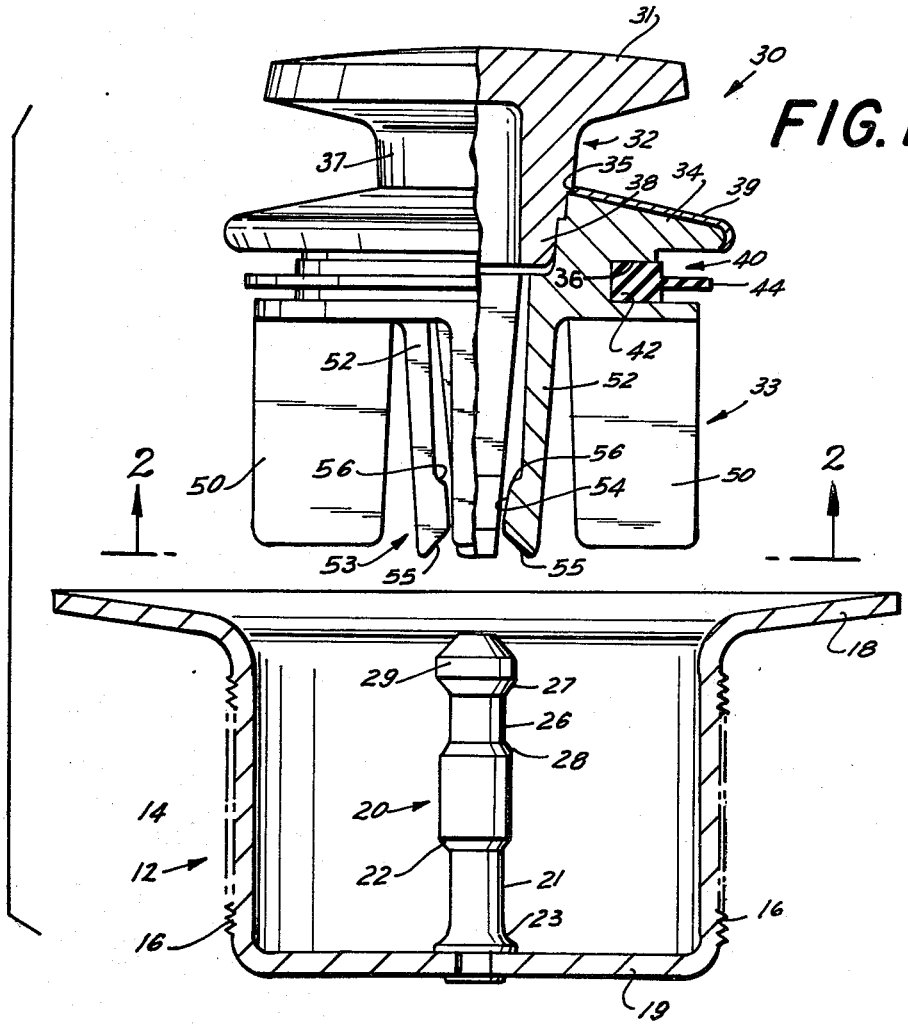
FIG. 1
FIG. 2
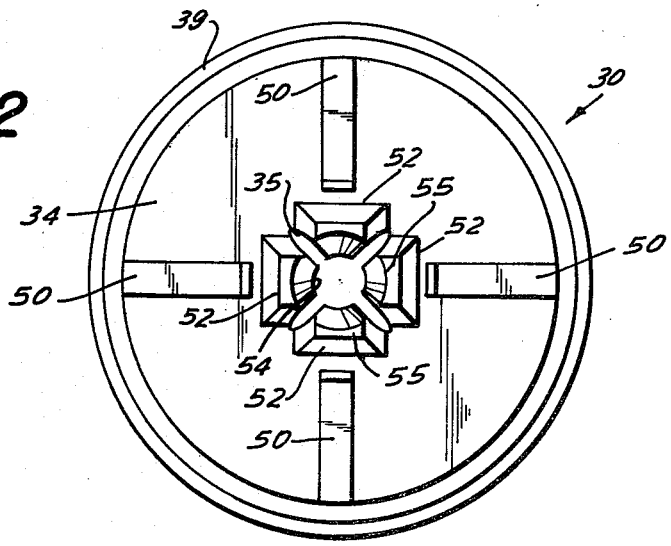

DRAIN VALVE ASSEMBLY

This is a continuation of application Ser. No. 766,167, filed Feb. 7, 1977 now abandoned.

BACKGROUND OF THE INVENTION

The invention relates to drain stoppers which are manually operated for opening and closing the drain port of a plumbing fixture such as a lavatory, sink or tub. Various types of manually operated drain valve assemblies commonly referred to as "finger-lift" drain assemblies are known, for example, those disclosed in the following U.S. Pat. Nos.: 1,403,432; 2,572,101; 3,010,120; 3,380,081; 3,609,776; and 3,771,177. These patents illustrate and describe manually operated drain valve assemblies mounted in a plumbing fixture and are distinguished from those drain valve assemblies which are remote controlled, that is, through manipulation of levers which utilize linkages to control the raising and lowering of the stopper.

SUMMARY OF THE INVENTION

The invention generally contemplates a valve assembly adapted for use in plumbing fixtures such as lavatories, sinks and tubs and are manually operated, commonly referred to as "finger-lift" type. The drain valve assembly is mounted in the drain port or opening of the plumbing fixture and comprises a unitary drain sleeve mounted therein having a valve seat formed at the open outer end and having an open inner end with a screen disposed transversely across the open inner or lower end for the passage of waste therethrough axially mounted within the drain sleeve in fixed position on the screen. A stopper is slidably and removably mounted for axial reciprocation on the stud and is provided with gripping means which cooperate with the stud for holding the stopper either in a raised or lowered position to permit water to drain from the plumbing fixture or in a lowered or closed position. A resilient seal means is mounted on the stopper for seating in fluid type relation with the valve seat when the stopper is is in the lowered or closed position.

It is an object of the present invention to provide a drain valve assembly which is simple to operate, easy to assemble and disassemble, which is inexpensive to manufacture, and which is simple to install.

BRIEF DESCRIPTION OF THE DRAWINGS

The invention will be readily understood from the following description of the accompanying drawings which illustrate one form of drain valve assembly of the present invention.

FIG. 1 is an enlarged exploded elevational view partially in section of the drain valve assembly of the invention herein;

FIG. 2 is a bottom plan view of the stopper taken along the line 2—2 of FIG. 1;

DESCRIPTION OF THE PREFERRED EMBODIMENT

Figure 3:
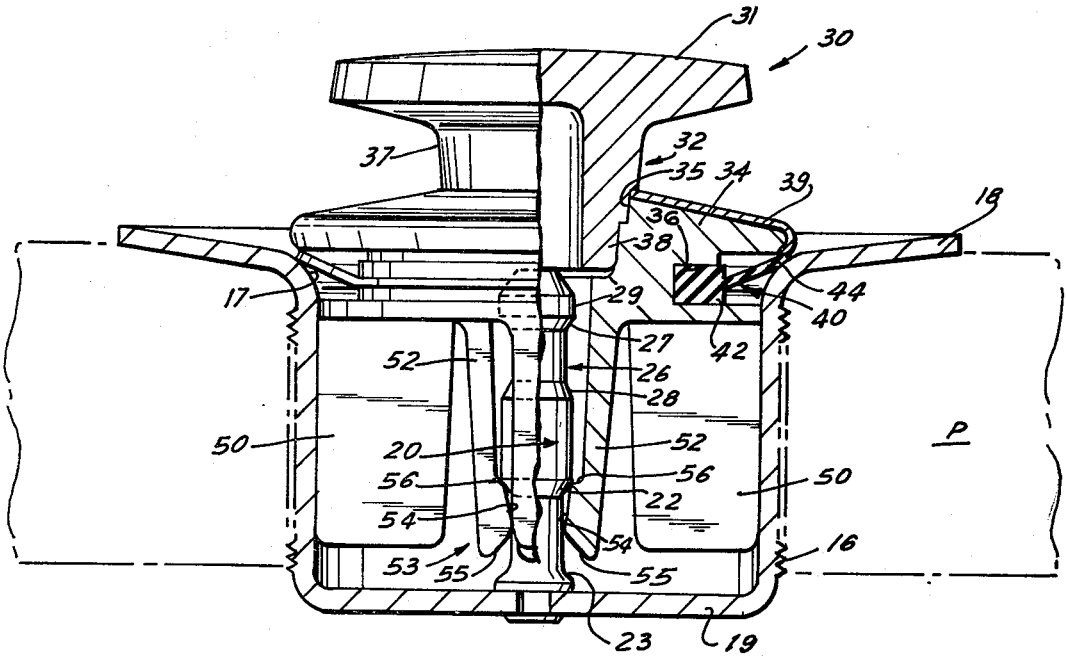
FIG. 3 is an enlarged elevational view partially in section of the drain assembly mounted in the drain port of a plumbing fixture and is shown in its closed or lowered position.

Referring to the drawings and principally to FIG. 1 drain valve assembly 10 comprises a drain sleeve 12 and stopper 30. Drain sleeve 12 is mounted in the drain port of the plumbing fixture "P" as seen in FIG. 3 and is adapted to be coupled to the waste or drain pipe, not shown. The drain sleeve and waste pipe are generally joined through a threaded coupling, not shown.

Drain sleeve 12 is generally in the form of an elongated cylindrical tube 14 having external threads 16 and a flange 18 integrally formed around the open outer end. Drain sleeve 12 is mounted in the drain port of the plumbing fixture in a water tight seal in the conventional manner as seen in FIG. 3. A beveled surface 17 which is formed between the open outer end of sleeve 14 and flange 18 functions as a valve seat to provide a water tight seal when stopper 30 is in its lowered or closed position. Formed integrally with cylindrical sleeve 14 at its open inner end is a transverse screen 19 with openings to permit waste water and/or small particles of waste material to pass therethrough. Stud 20 is preferably in the form of an elongated metal rod and is positioned axially within sleeve 14 and below the outer rim or flange of drain sleeve 12. Stud 20 is mounted in position on screen 19 preferably by being staked or riveted to prevent its accidental removal, however, any suitable mounting means may be employed such as being threaded to a nut fixed to screen 19 or screwed into an opening in screen 19.

Two spaced areas or annular rings 21 and 26 are provided on stud 20 for positioning stopper 30 in its raised or open position and in its lowered or closed position. Areas 21 and 26 are similar in design and have corresponding beveled surfaces 22 and 27 and 23 and 28. These beveled surfaces alternately function as camming surfaces to facilitate the shifting of stopper 30 from its raised position to its lowered position and vice versa and also function as stop means to hold stopper 30 in its raised or lowered position. The upper end 29 of stud 20 is slightly larger in diameter than its shank portion to prevent accidental removal of stopper 30 when being shifted from its closed to its open position.

Stopper 30 is preferably made of a moldable plastic material such as, Marbon Cyclolac EP 3570, manufactured by the Marbon Div., Borg-Warner Corp. and for ease of manufacture is made in two segments, a knob or finger lift segment 32 and a plug segment 33.

Plug segment 33 includes a curved or spherical dome section 34 and is provided with a central recess or opening 35 for mounting knob 32 therein. Dome section 34 has a diameter greater than the internal diameter of sleeve 14. Annular recess 36 for mounting a flexible seal means 40 therein, as shown in FIG. 1, is spaced from dome section 34 and is formed around the circumference of plug segment 33. Flexible seal means 40 is formed having an inner ring section 42 which nests in annular recess 36 and lateral flange or flexible skirt 44 extending therefrom. Flexible skirt 44 presses against valve seat 17 to form a water tight seal when plug 30 is in the closed position as shown in FIG. 3.

Plug segment 33 has an outside diameter less than the inside diameter of sleeve 14, however, seal means 40 has a diameter greater than the diameter of sleeve 14 so that flexible skirt 44 will nest against valve seat 17 to form a water tight seal when stopper 30 is in its closed position.

A plurality of integrally formed guide members 50 are radially disposed around dome segment 34. Guide members 50 preferably are equally spaced around dome segment 34 such as shown in FIG. 2. Guide members 50 are in the form of a rectangle having a length shorter than the length of sleeve 14 and a width of about ⅓ of the diameter of sleeve 14 and prevents accidental tipping and removal of stopper 30 about its longitudinal axis. It is preferred that four guide members 50 be positioned along the perpendicular diameters of plug segment 33 as seen in FIG. 2. Spaced from guide members 50 and circumferencially disposed around central opening 35 in dome segment 34 are a plurality of gripping fingers 52. As seen in FIGS. 1 and 2, gripping fingers 52 have a length slightly greater than guide members 50 but less than the length of sleeve 14. Each guide finger is tapered radially inward at a taper of about three degrees so that the opening formed at the lower end of the fingers has a diameter less than the diameter of the shank portion of stud 20. Lower inside corners of guides 50 are designed to limit deflection of guide fingers 52 and prevent fingers from being stressed to failure point when stopper 30 is removed from drain sleeve 15 and stud 20.

Figure 4:
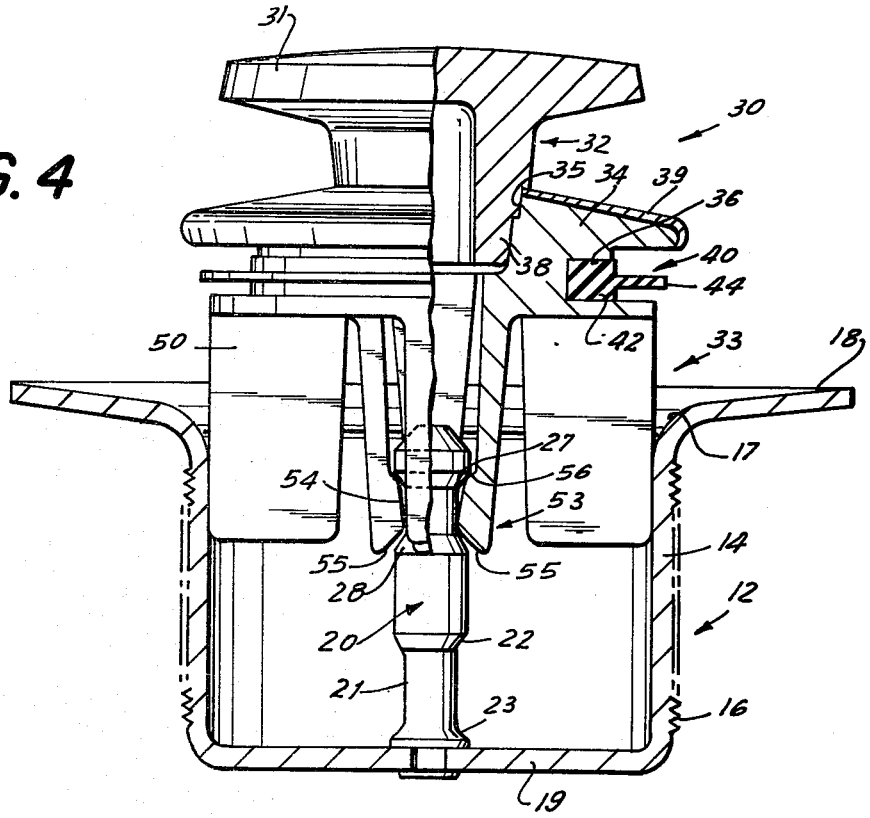
FIG. 4 is an elevational view partially in section of the drain valve assembly in its raised or opened position.

As seen in FIG. 2, four guide fingers 52 are circumferencially spaced about opening 35 of dome segment 34 along the perpendicular diameters which pass through guide member 50. Inwardly extending gripping means 53 are formed at the lower ends of guide fingers 52. Gripping means 53 have converging beveled surfaces 55, 56 that are inclined at about a 45° angle with the longitudinal axis of plug 30. Beveled surfaces 55, 56 and curved surface 54 function as cam followers when guided along beveled surfaces 22, 28 of stud 20 when stopper 30 is shifted to its opened and closed position and beveled surfaces 55, 56 function as stop means when biased against surfaces 23, 27 of stud 20. When shifting stopper 30 from its closed or open position as shown in FIGS. 3 and 4, camming surface 22 of stud 20 forces guide fingers 52 outwardly until curved surfaces 54 of the guide fingers ride along the shank portion of stud 20. As guide fingers 52 approach camming surface 28, the pressure exerted by the guide fingers on stud 20 will cause the stopper 30 to automatically ride along cam surface 28 to raise the stopper to its full open position without any further force in an upward direction. Conversely as guide fingers 52 approach cam surface 22, stopper 30 will snap automatically into a closed fluid tight position as seen in FIG. 3, due to the pressure of the guide fingers exerted against stud 20.

Knob or finger-lift segment 32 includes a finger lift or head portion 31 and a tapered shank portion 37 with its lower end 38 shaped so as to nest in central opening 35 as seen in FIG. 1. Finger lift section 32 is mounted to plug segment 35, by suitable adhesive means as by solvent welding, for example, using methylene chloride or trichloroethylene as solvents.

To enhance the appearance of the finger-lift knob and the dome segment of stopper 30, the molded plastic surfaces may be capped with a metallic surface 39 such as a chrome plated metal sheet or may be electroplated with a suitable metallic finish corresponding to the metallic surfaces of the drain sleeve.

Having described the invention, it is obvious that many changes in material and design may be had without departing from the spirit of the invention described and shown herein.

What is claimed is:

1. A drain valve assembly of the finger lift type for mounting in a drain port of a plumbing fixture, said assembly consisting essentially of:

a unitary drain sleeve for mounting in the drain port of a plumbing fixture and a stopper mounted in said drain sleeve and being shiftable to an open and closed position in said sleeve;

said unitary drain sleeve having an open outer end and an open inner end for the passage of waste therethrough;

a radially extending flange integrally formed around the open outer end of said sleeve;

a beveled surface provides valve seat formed at the junction of the flange and said open outer end of said sleeve;

a screen integrally formed with said drain sleeve and disposed across the open inner end of said sleeve;

an elongated stud fixedly positioned in axial relation within said sleeve along the longitudinal axis thereof and mounted on said screen in fixed position;

said stud having a height measured from its mounting location on said screen and extending to the lower edge of said beveled surface which surface forms said valve seat;

stop means formed adjacent each end of said stud;

said stud including spaced upper and lower symmetrical annular rings having corresponding beveled surfaces which function alternately as camming surfaces when said stopper is shifted to its opened and closed positions and as stop means when said stopper is in its opened or closed position;

said stopper removably mounted on said stud and having gripping means for cooperating with said stop means for holding said stopper in a raised or opened position to permit waste water to drain from said plumbing fixture and a closed or lowered position;

said gripping means including a plurality of elongated spaced, circumferentially disposed, inwardly tapered fingers, the ends of said fingers having converging beveled surfaces extending radially inwardly which, when mounted on said stud, form a sliding frictional grip when said stopper is shifted alternately from a closed to an open position; and a resilient seal means mounted on said stopper and extending radially therefrom for mating with said valve seat at said outer end of said drain sleeve in fluid tight relation when said stopper is shifted to its closed or lowered position.

2. The valve assembly of claim 1 wherein said gripping fingers are integrally molded with said stopper and are formed along perpendicular diameters and are four in number.

3. The drain valve assembly of claim 1 wherein said drain sleeve is cylindrical and is formed of metal.

4. The drain valve assembly of claim 1 wherein said stopper is molded plastic and has a knob segment and stopper segment, said stopper segment including a plurality of integrally molded circumferentially spaced radially disposed elongated guide members.

5. The valve assembly of claim 4 wherein the plurality of guide members are integrally molded with said stoppers formed along perpendicular diameters and are four in number.

* * * * *